US008662332B2

(12) United States Patent
Wurster et al.

(10) Patent No.: US 8,662,332 B2
(45) Date of Patent: Mar. 4, 2014

(54) PASTEURIZABLE AND HOT-FILLABLE PLASTIC CONTAINER

(75) Inventors: Michael P. Wurster, York, PA (US); Justin A. Howell, New Cumberland, PA (US); Michael T. Kelly, Manchester, PA (US); Robert Waltemyer, Felton, PA (US); Benton A. Lewis, Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 501 days.

(21) Appl. No.: 12/573,901

(22) Filed: Oct. 6, 2009

(65) Prior Publication Data

US 2011/0079575 A1 Apr. 7, 2011

(51) Int. Cl.
*B65D 90/02* (2006.01)

(52) U.S. Cl.
USPC ..... 215/383; 215/371; 215/373; 215/375; 215/381; 215/382; 215/396; 220/608; 220/624; 220/669; 220/606

(58) Field of Classification Search
USPC ..... 215/379, 382, 383; 220/606, 608, 609, 220/633, 635
See application file for complete search history.

(56) References Cited

U.S. PATENT DOCUMENTS 4,054,219 A 10/1977 Young et al.
4,108,324 A 8/1978 Krishnakumar et al.
5,005,716 A * 4/1991 Eberle ..... 215/373
D338,832 S 8/1993 Osip et al.
5,477,974 A 12/1995 Reil et al.
D366,416 S 1/1996 Semersky
5,908,128 A 6/1999 Krishnakumar et al.
5,989,661 A 11/1999 Krishnakumar et al.
D423,366 S 4/2000 Gans
6,065,624 A 5/2000 Steinke
D426,469 S 6/2000 Mankowski et al.
D445,339 S 7/2001 Bazlur
D446,458 S 8/2001 Gans
D448,675 S 10/2001 Thierjung
D451,401 S 12/2001 Silvers et al.
6,413,466 B1 7/2002 Boyd et al.

(Continued)

FOREIGN PATENT DOCUMENTS

JP 2000229615 8/2000
WO 2009120988 10/2009

OTHER PUBLICATIONS

International Search Report dated Dec. 14, 2010 for corresponding PCT/US2010/051424 filed Oct. 5, 2010.

*Primary Examiner* — Anthony Stashick
*Assistant Examiner* — Cynthia Collado
(74) *Attorney, Agent, or Firm* — Baker Botts L.L.P.

(57) ABSTRACT

A blow molded plastic container for hot fill and pasteurization uses includes a main body portion that is shaped so as to be substantially round in horizontal cross-section and a base portion. The base portion is shaped to define a generally circular standing ring and an elevated push-up portion that is positioned radially inward of the standing ring. The push-up portion includes a central region, an annular, substantially straight and substantially vertical rise portion that is positioned immediately radially inward of the standing ring and a plurality of radially oriented waves. Each of the waves extends radially outwardly from the central region to the vertical rise portion and is preferably shaped so as to subtend a substantially constant angle along its length.

7 Claims, 5 Drawing Sheets

(56) References Cited

U.S. PATENT DOCUMENTS

| | | | | |
|---|---|---|---|---|
| 6,439,413 | B1 | 8/2002 | Prevot et al. | |
| 6,460,714 | B1 | 10/2002 | Silvers et al. | |
| D465,418 | S | 11/2002 | Thierjung | |
| 6,585,123 | B1 | 7/2003 | Pedmo et al. | |
| D480,313 | S | 10/2003 | Johnson et al. | |
| 6,634,517 | B2 * | 10/2003 | Cheng et al. | 215/373 |
| 6,763,968 | B1 | 7/2004 | Boyd et al. | |
| D495,602 | S | 9/2004 | Daly et al. | |
| 6,920,992 | B2 | 7/2005 | Lane et al. | |
| 7,073,675 | B2 | 7/2006 | Trude | |
| 7,080,747 | B2 | 7/2006 | Lane et al. | |
| D539,661 | S | 4/2007 | Eble | |
| D581,286 | S | 11/2008 | White | |
| D588,935 | S | 3/2009 | Richardson et al. | |
| 8,096,434 | B2 * | 1/2012 | Bunel et al. | 215/376 |
| 2003/0052076 | A1 * | 3/2003 | Cheng et al. | 215/373 |
| 2003/0196926 | A1 | 10/2003 | Tobias et al. | |
| 2004/0211746 | A1 | 10/2004 | Trude | |
| 2006/0118508 | A1 | 6/2006 | Kraft et al. | |
| 2006/0131257 | A1 * | 6/2006 | Gatewood et al. | 215/373 |
| 2008/0000867 | A1 | 1/2008 | Lane et al. | |
| 2008/0047964 | A1 * | 2/2008 | Denner et al. | 220/624 |

* cited by examiner

PASTEURIZABLE AND HOT-FILLABLE PLASTIC CONTAINER

BACKGROUND OF THE INVENTION

1. Field of the Invention

This invention relates to blow molded plastic containers, and particularly blow molded plastic containers that are designed to accommodate the pressurization and vacuum forces that are inherent in the pasteurization and/or hot fill processes.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

The use of blow molded plastic containers for the purpose of packaging liquids that are processed by hot filling and/or pasteurization processes has been known for some time. The hot fill process involves filling the containers while the liquid product is at an elevated temperature, typically 68° C. to 96° C. (155° F.-205° F.) and usually about 85° C. (185° F.) in order to sterilize the container at the time of filling. Containers that are designed to withstand the hot fill process are known as "hot fill" or "heat set" containers. Such containers are typically designed with sidewalls that include one or more vacuum panels that are designed to flex due to the temperature changes and consequent volumetric expansion and contraction that takes place during processing.

Pasteurization subjects a container to greater internal pressures and volumetric changes than occurs with hot-fill processing. This is due to the higher processing temperatures, and, therefore, the greater volumetric expansion and contraction of the contained products and associated vapor.

Hot fill and pasteurizable containers must be designed to be strong enough in the areas outside of the vacuum panel regions so that the deformation that occurs as a result of the volumetric shrinkage of a product within the container is substantially limited to the portions of the container that are designed specifically to accommodate such shrinkage. Ideally, this is done while keeping the container as lightweight as possible, because PET resin is relatively expensive.

The sidewall portions of hot fill and pasteurizable containers must be designed to prevent excessive deformation, particularly in containers that are not designed to be substantially circular or round as viewed in horizontal cross-section. In addition, the base of such containers must be designed to be stable and to prevent excessive deformation. PET hot fill and pasteurizable containers typically have a modified champagne style base that defines an outer standing ring on which the container is designed to be supported when placed on a flat horizontal surface, and a central, elevated push-up region. The push-up region of such containers has a tendency to deform when the container is under pressure, which can cause the material near the standing ring to roll or deflect outwardly, thus compromising the stability of the base.

A need exists for an improved blow molded plastic container for use in hot fill and pasteurizable applications that has a sidewall and base portion that both remain relatively stable under various conditions of pressurization and temperature that occur during such processes.

SUMMARY OF THE INVENTION

Accordingly, it is an object of the invention to provide an improved blow molded plastic container for use in hot fill and pasteurizable applications that has a sidewall and base portion that both remain relatively stable under various conditions of pressurization and temperature that occur during such processes.

In order to achieve the above and other objects of the invention, a blow molded plastic container according to a first aspect of the invention includes a main body portion that is shaped so as to be substantially round in horizontal cross-section. It further includes a champagne-type base portion that has a generally circular standing ring and an elevated push-up portion that is positioned radially inward of the standing ring. The push-up portion has a bottom wall portion that is shaped to define a central region and an annular, substantially straight and substantially vertical rise portion that is positioned immediately radially inward of the standing ring, and that includes a plurality of radially oriented waves, each of said waves extending radially outwardly from said central region to said vertical rise portion.

According to a second aspect of the invention, a blow molded plastic container includes a main body portion that is shaped so as to be substantially round in horizontal cross-section and a champagne-type base portion. The base portion defines a generally circular standing ring and an elevated push-up portion that is positioned radially inward of the standing ring. The push-up portion has a bottom wall portion that is shaped to define a central region; and a plurality of radially oriented waves. Each of the waves extends radially outwardly from the central region toward the standing ring and is shaped so as to subtend a substantially constant angle along its length.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
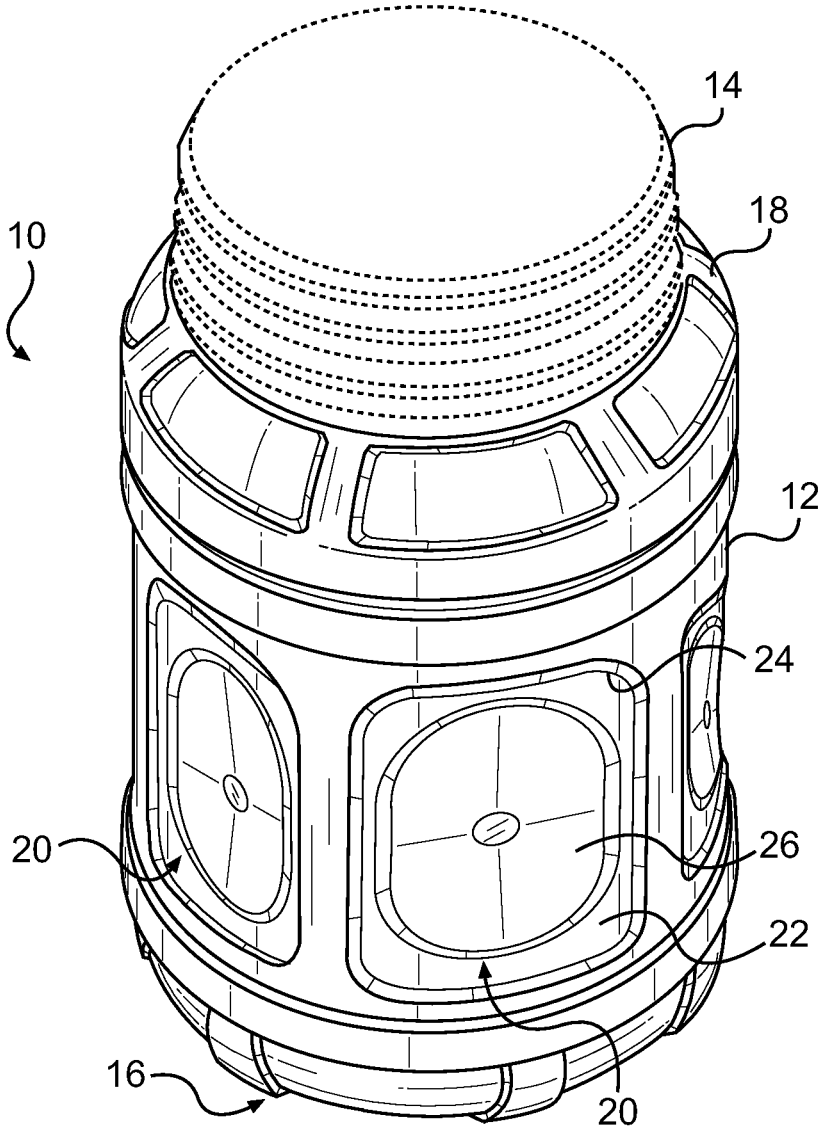
FIG. 1 is a perspective view depicting a blow molded plastic container according to a preferred embodiment of the invention.
Figure 2:
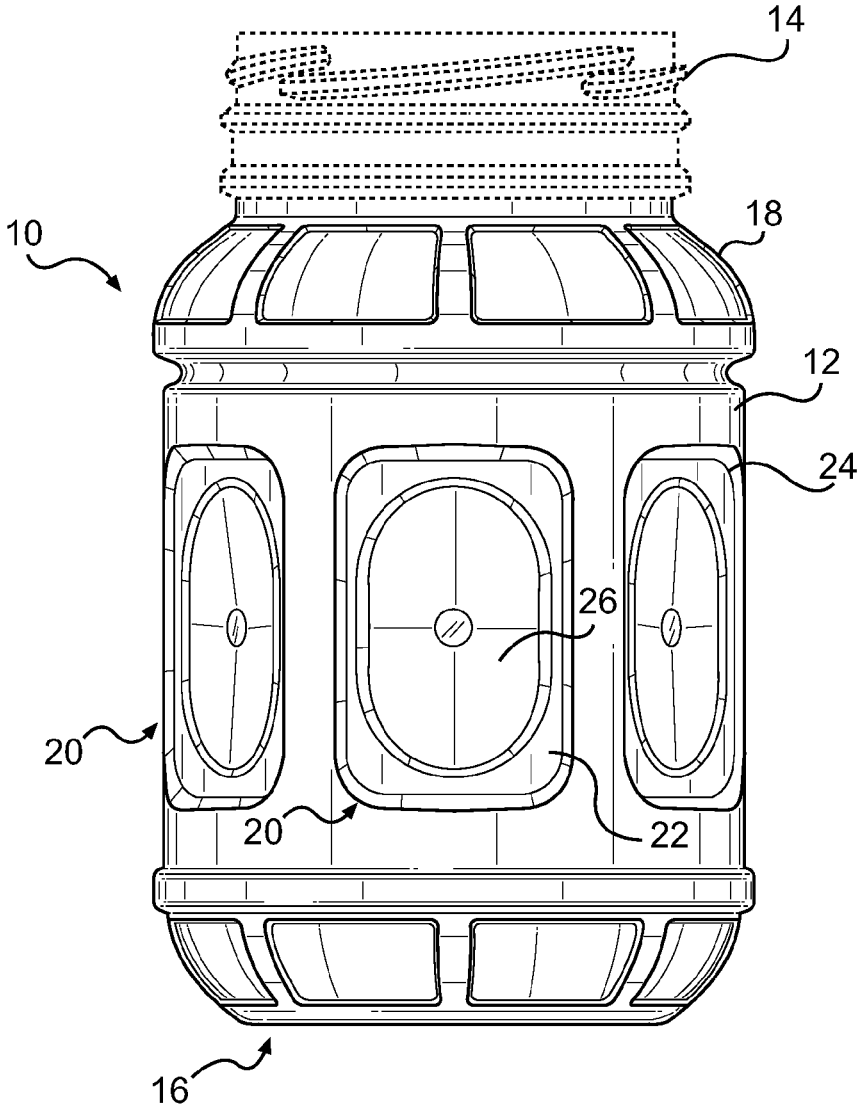
FIG. 2 is a side elevational view of the container that is depicted in FIG. 1.

Referring now to the drawings, wherein like reference numerals designate corresponding structure throughout the views, and referring in particular to FIG. 1, a blow molded plastic container 10 is constructed and arranged to be pasteurizable and/or adapted to be used for packaging liquid products at elevated temperatures according to the well-known hot-fill process.

Blow molded plastic container 10 is preferably fabricated from polyethylene terephthalate, commonly known by the acronym PET, using a conventional blowmolding process. It preferably includes a main body portion 12, a threaded nipple portion 14 that is provided with one or more helical threads for receiving a threaded lid, a base portion 16 and a shoulder portion 18 that is unitary with the threaded nipple portion 14 and the main body portion 12.

The main body portion 12 is preferably shaped so as to be substantially round or circular in horizontal cross-section. It preferably includes a plurality of vacuum panels 20 that are spaced about the outer circumference of the main body portion 12. In the preferred embodiment, eight vacuum panels 20 are provided. Each vacuum panel 20 includes a generally rectangular outer portion 22, preferably having rounded corner portions 24, and a generally oval inner portion 26.

Figure 4:
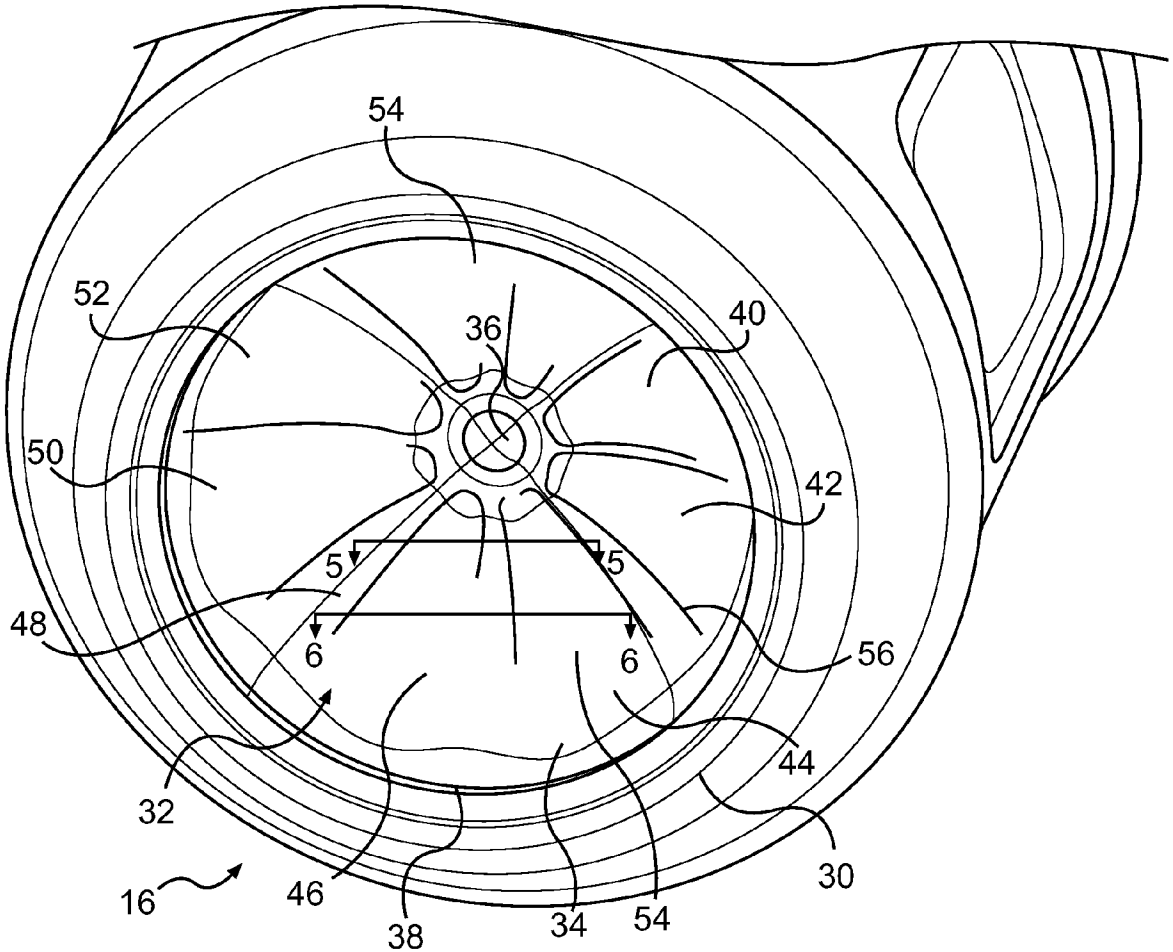
FIG. 4 is a fragmentary perspective view of a bottom portion of the container that is depicted in FIG. 1.

Referring briefly to FIG. 4, base portion 16 is shaped so as to define a circular standing ring 30 that is adapted to be supported on an underlying flat horizontal surface such as a table or refrigerator shelf. Standing ring 30 preferably extends continuously in unbroken fashion about the lower periphery of the base portion 16. Base portion 16 further includes an elevated push-up portion 32 that is positioned radially inward of the standing ring 30. The elevated push-up portion 32 has a bottom wall portion 34 that is shaped to define a central region 36 that includes a gate structure and that is substantially centered with respect to the elevated push-up portion 32 and the generally circular standing ring 30.

Figure 3:
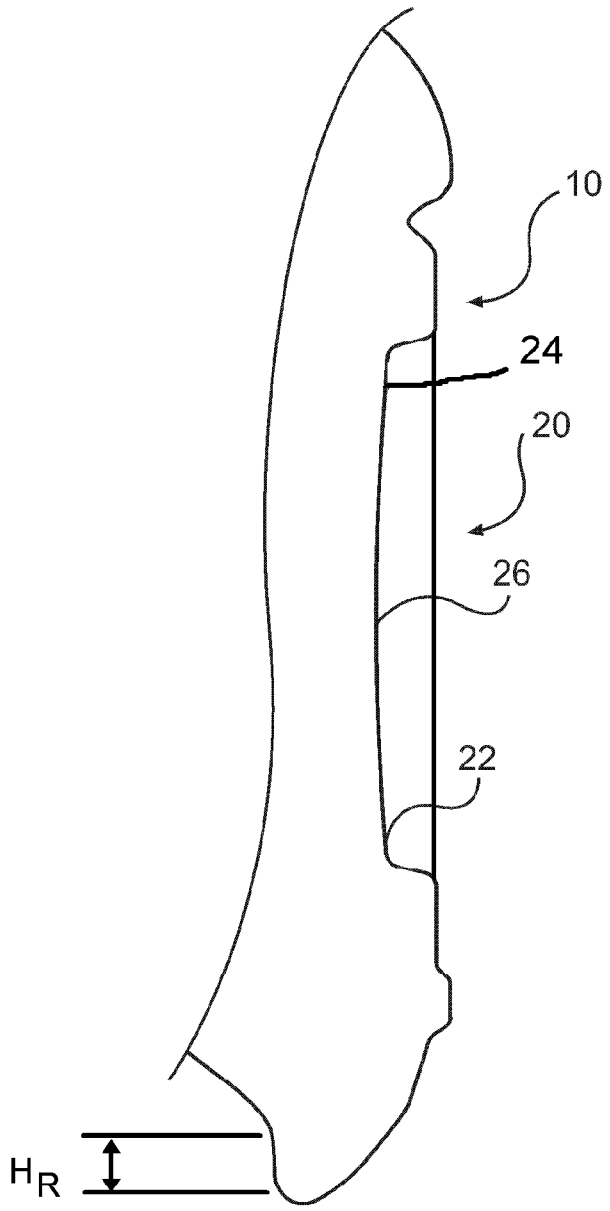
FIG. 3 is a longitudinal cross-sectional view of the container that is depicted in FIG. 1.

The base portion 16 also preferably includes an annular, substantially straight vertical rise portion 38, best shown in FIG. 3, that is positioned immediately radially inward of the standing ring 30. The vertical rise portion 38 preferably extends for a vertical height $H_R$ from the bottom of the standing ring 30 that is preferably within a range of about 0.036 inch to about 0.2 inch.

According to one particularly advantageous feature of the invention, base portion 16 also includes a plurality of radially oriented waves 40, 42, 44, 46, 48, 50, 52, best shown in FIG. 4, that extend radially outwardly from the central region 20 to the vertical rise portion 38. Each of the radially oriented waves 40, 42, 44, 46, 48, 50, 52 includes a peak portion 54 that is preferably convexly radiused to extend downwardly and a trough portion 56 that is preferably concavely radiused so as to extend upwardly. A first cross-sectional view taken along lines 5-5 in FIG. 4 showing a plurality of the radially oriented waves 40, 42, 44, 46, 48, 50, 52 and their respective peak and trough portions 54, 56 at a location that is adjacent to the central region 20 is provided in FIG. 5. A second cross sectional view taken along lines 6-6 in FIG. 5 showing a plurality of the radially oriented waves in the respective peak and trough portions 54, 56 at a location that is adjacent to the vertical rise portion 38 is shown in FIG. 6.

The peak portion 54 of each respective radially oriented wave 40, 42, 44, 46, 48, 50, 52 defines a radially oriented axis. Each of the wave peaks 40, 42, 44, 46, 48, 50, 52 also defines a first transverse mean radius of curvature $R_1$, shown in FIG. 5, at a first location that is shown in FIG. 4. Each of the wave peaks further defines a second transverse mean radius of curvature $R_2$, shown in FIG. 6, at a second location that is shown in FIG. 4. The second location is positioned so as to be radially outward from the first location. The second transverse mean radius of curvature $R_2$ is preferably greater than the first transverse mean radius of curvature $R_1$, meaning that the peak portions of the waves tend to increase in both amplitude and width in proportion to the distance from the central region 36 of the bottom portion 16.

Figure 5:
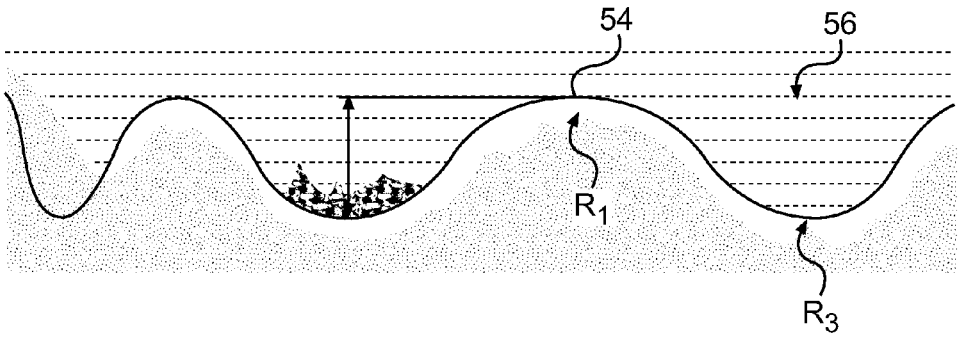
FIG. 5 is a cross-sectional view taken along lines 5-5 in FIG. 4.
Figure 6:
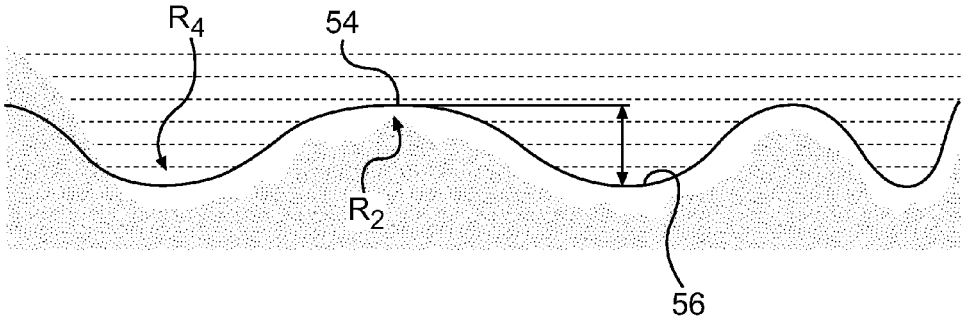
FIG. 6 is a cross-sectional view taken along lines 6-6 in FIG. 4.

Likewise, the trough portion 56 of each of the waves also defines a radially oriented axis, and each of the waves defines a first trough transverse mean radius of curvature $R_3$, shown in FIG. 5, at the first location that is shown in FIG. 4. Each of the waves further defines a second trough transverse mean radius of curvature $R_4$, shown in FIG. 6, at the second location that is shown in FIG. 4. The second location is positioned so as to be radially outward from the first location. The second transverse mean radius of curvature $R_2$ is preferably greater than the first transverse mean radius of curvature $R_1$, meaning that the trough portions of the waves also tend to increase in amplitude and width in proportion to the distance from the central region 36 of the bottom portion 16.

Preferably, both the trough portions 54 and the peak portions 56 are shaped so as to subtend a substantially constant angle along their respective lengths from the central region 36 to the vertical rise portion 38.

The waves 40, 42, 44, 46, 48, 50 are preferably symmetrically arranged about the central region 36, meaning that each of the waves has a diametrically opposed counterpart wave positioned immediately and symmetrically opposite the central region 36.

Preferably, at least four waves are provided. More preferably, at least six waves are provided. In the preferred embodiment, eight waves are provided. More than eight waves could also be provided within the scope of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A blow molded plastic container, comprising:

a main body portion, said main body portion being shaped so as to be substantially round in horizontal cross-section; and a champagne-type base portion, said base portion defining a generally circular standing ring and an elevated push-up portion that is positioned radially inward of said standing ring, and wherein said push-up portion has a bottom wall portion that is shaped to define:

a central region;

an annular, substantially straight and substantially vertical rise portion that is positioned immediately radially inward of said standing ring; and a plurality of radially oriented waves, each of said waves extending radially outwardly from said central region to said vertical rise portion, each of said waves further being shaped so as to subtend a substantially constant angle along its length from the central region to the vertical rise portion; and wherein each of said waves includes a peak portion that is convexly radiused to extend downwardly and a trough portion that is concavely radiused to extend upwardly, and wherein each of the peak portions and trough portions of the waves increases in both amplitude and width in proportion to the distance from the central region of the bottom portion.

2. A blow molded plastic container according to claim 1, wherein said vertical rise portion extends for a vertical height from said standing ring that is preferably within a range of about 0.036 inch to about 0.2 inch.

3. A blow molded plastic container according to claim 1, wherein said waves are symmetrically arranged about said central region.

4. A blow molded plastic container according to claim 1, wherein at least four of said waves are provided.

5. A blow molded plastic container according to claim 1, wherein at least six of said waves are provided.

6. A blow molded plastic container according to claim 1, wherein said container is fabricated from polyethylene terephthalate (PET).

7. A blow molded plastic container according to claim 1, wherein said peak portion has a radially oriented axis, a first transverse mean radius of curvature at a first location, and a second transverse mean radius of curvature at a second location that is radially outward from said first location, and wherein said second transverse mean radius of curvature is greater than said first transverse mean radius of curvature.

* * * * *